US005282547A

United States Patent [19]

Murray

[11] Patent Number: 5,282,547

[45] Date of Patent: Feb. 1, 1994

[54] SPLASHGUARD FOR CORNER-POSITIONED DISHWASHERS

[76] Inventor: Joseph A. Murray, 116 Smoke Rise Dr., Warren, N.J. 07059

[21] Appl. No.: 952,587

[22] Filed: Sep. 28, 1992

[51] Int. Cl.[5] ..... B65D 53/04

[52] U.S. Cl. ..... 220/731; 220/729; 220/342; 134/115 R; 134/201

[58] Field of Search ..... 134/115 R, 201; 312/228, 228.1, 229; 220/334, 342, 731, 729, 4.03

[56] References Cited

U.S. PATENT DOCUMENTS

| | | | |
|---|---|---|---|
| 541,858 | 7/1895 | Inger | 312/229 |
| 657,930 | 9/1900 | Feldkircher | 312/229 |
| 964,757 | 7/1910 | Christensen | 220/334 |
| 1,765,871 | 6/1930 | Johnson | 220/731 |
| 2,254,431 | 9/1941 | Levine | 312/229 |
| 2,538,233 | 1/1951 | Brandstrom | 312/229 |
| 4,195,744 | 4/1980 | Christianson | 220/334 |
| 4,739,781 | 4/1988 | Casoli | 134/115 R |
| 4,848,587 | 7/1989 | Nipp | 220/334 |
| 4,854,463 | 8/1989 | Cyr | 220/334 |
| 4,982,857 | 1/1991 | Sher | 220/4.03 |

FOREIGN PATENT DOCUMENTS

| | | | |
|---|---|---|---|
| 138431 | 2/1920 | United Kingdom | 220/334 |

*Primary Examiner*—Stephen P. Garbe
*Assistant Examiner*—S. Castellano
*Attorney, Agent, or Firm*—Horst M. Kasper

[57] ABSTRACT

A splashguard device for a dishwasher includes an angular sector of a circular plate. A sector angle of the angular sector has an angle of from about 100 to 130 degrees. The radius of the circular plate substantially equals the radial length of a dishwasher door determined from the hinge axis of the dishwasher door. A plurality of fastening devices permanently secures the angular sector at a radially extending edge to a radially directed side face of the dishwasher door. Spacer devices are provided for spacing the angular sector at a distance of approximately 0.5 inch from the radially extending side face of the dishwasher door in a vertical plane parallel to an outer face of a dishwasher outside wall. A guide is attached to the dishwasher outside wall to ensure a free movement of the splashguard.

20 Claims, 10 Drawing Sheets

SPLASHGUARD FOR CORNER-POSITIONED DISHWASHERS

BACKGROUND OF THE INVENTION

1. Field of the Invention

The invention relates to an improvement for a dishwasher in a kitchen environment.

2. Brief Description of the Background of the Invention Including Prior Art

Dishwashers have been produced conventionally for installation in kitchens. In general, it was desired that the dishwasher be accessible from various sides and, therefore, a mounting position in a corner was not practical. However, in view of the cost associated with space in housing, kitchens of only a limited size are frequently available and, consequently, it may be necessary and desirable to place a dishwasher in a corner of a kitchen.

Manufacturers of household dishwashers frequently advise prospective buyers not to install a dishwasher unit in an inside corner. The reason for this is that, when loading the dishwasher, items may or may not be rinsed off, resulting in fluids and/or food particles to fall onto the horizontal surface of the opened dishwasher door, and to splash onto the adjacent walls or cabinets. Also, when the dishwasher door is opened, soon after its operation, hot humid air will escape. If the dishwasher door is opened during the washing cycle, hot water vapors will also be combined with the cleaning detergent. These hot water vapors, with or without cleaning detergent, will condense on any adjacent cool surfaces. Repeated exposure of walls, cabinets and adjacent surfaces to the above-mentioned adverse conditions and frequent cleaning thereof will eventually cause the protective finish to be damaged and/or corroded. In particular, finished wood surfaces will eventually discolor, swell, warp, and/or crack.

SUMMARY OF THE INVENTION

1. Purposes of the Invention

It is an object of the present invention to provide an attachment to a dishwasher which allows installation of the dishwasher in corner areas.

It is another object of the present invention to provide a means to prevent corrosion of adjacent areas in connection with the use of the dishwashing equipment.

It is yet a further object of the invention to prevent damage to the protective finish of wooden and other common surfaces next to a dishwasher, such as discoloration, swelling, warping, and/or cracking.

It is yet another object of the present invention to provide a reliable method of containing liquids, vapors and food particles which can emanate from dishwashers within defined areas.

These and other objects and advantages of the present invention will become evident from the description which follows.

2. Brief Description of the Invention

According to the present invention, a splashguard device is provided for a dishwasher, consisting of an angular sector of a circular plate. The sector angle of the angular sector has an angle of approximately 100 to 130 degrees. The radius of the circular plate substantially equals the radial length of the dishwasher door, determined from the hinge axis of the dishwasher door. A plurality of fastening devices attach the angular sector permanently to the dishwasher door. Spacer devices position the angular sector at a distance of approximately ½ inch away from the radially extending side face of the dishwasher door. This will allow the splashguard to move in a vertical plane, parallel to the outer face of the dishwasher side wall when opening or closing the dishwasher door.

The sector angle can have an angle of approximately 100 to 130 degrees, and preferably 105 to 120 degrees and can have a thickness of approximately 0.5 centimeter to 1 centimeter.

The angular sector of the circular plate should have some sturdiness of body and have the same smooth surface on both sides, so it can be installed on either side of the dishwasher door. It can be made of plastic, acrylic, stainless steel, steel, or aluminum. The angular sector of the circular plate can comprise a copper alloy. The angular sector of the circular plate can be coated with a metal enamel or with a ceramic enamel. The metal enamel is an enamel applied to a metal surface. The ceramic enamel is an enamel comprising a substantial amount of ceramic materials. The angular sector of the circular plate can also be coated with a plastic coating resistant to heat, scratching, water, and corrosion.

The fastening devices can include screws attached to the radially directed side face of the door.

The spacer devices can be provided by bushings. The purpose thereof is to space the splashguard away from the edge of the door and away from the outside wall of the dishwasher. This will allow the splashguard to slide along the outside of the dishwasher and move freely when opening and closing the door. The bushings can be made of ⅜ inch chrome-plated copper tubing.

A guide for the angular sector can be installed on the outside side-wall of the dishwasher and can guide the angular sector substantially within a vertical plane during the swivelling of the dishwasher door. The guide can be provided by a flat piece of metal together with a bracket so that the bracket straddles a part of the periphery of the angular sector depending on the position of the dishwasher door. The guide can include rubber bumpers mounted on the bracket and facing the angular sector to avoid wear and scratching of the angular sector when sliding through the guide.

For a finished look and also for additional support, a piece of channelled chrome trim could be installed to cover the entire edge of the splashguard.

This splashguard can be offered as an optional kit at the time of the initial purchase of the dishwasher. All holes, notches, etc. for the installation of this kit on either side of the dishwasher door should be factory-predrilled and covered with matching caps if the kit is not needed. Also, the splashguard kit could be offered as a separate unit, with instructions for easy installation for dishwashers already in place, or not equipped with factory-predrilled holes, notches, etc..

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
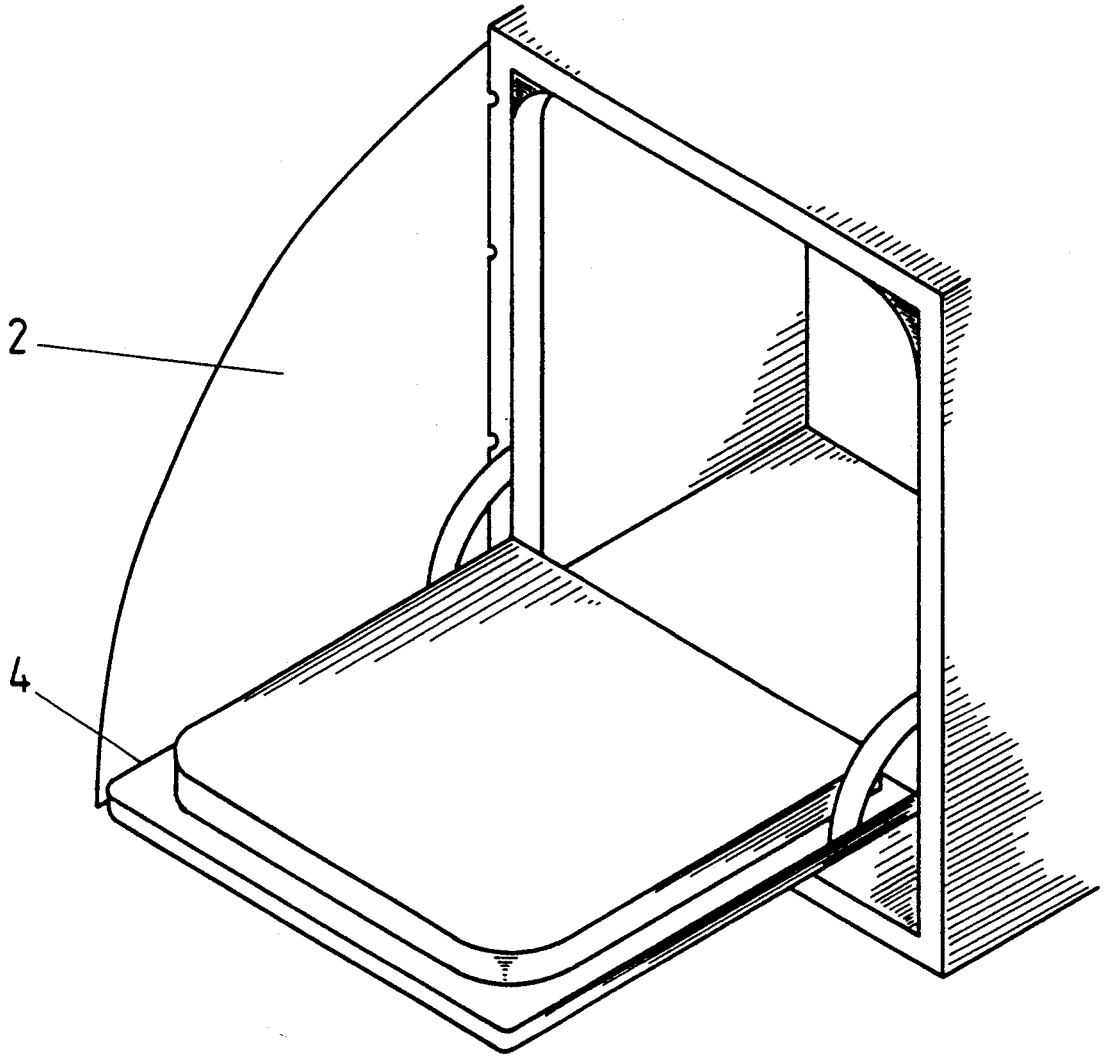
FIG. 1 is a perspective view of a dishwasher in an open position with a splashguard.

A dishwasher with a splashguard 2 according to the present invention can be installed in an inside corner as illustrated in FIG. 1.

FIG. 1 illustrates a general perspective overview of the invention splashguard 2.

Figure 2:
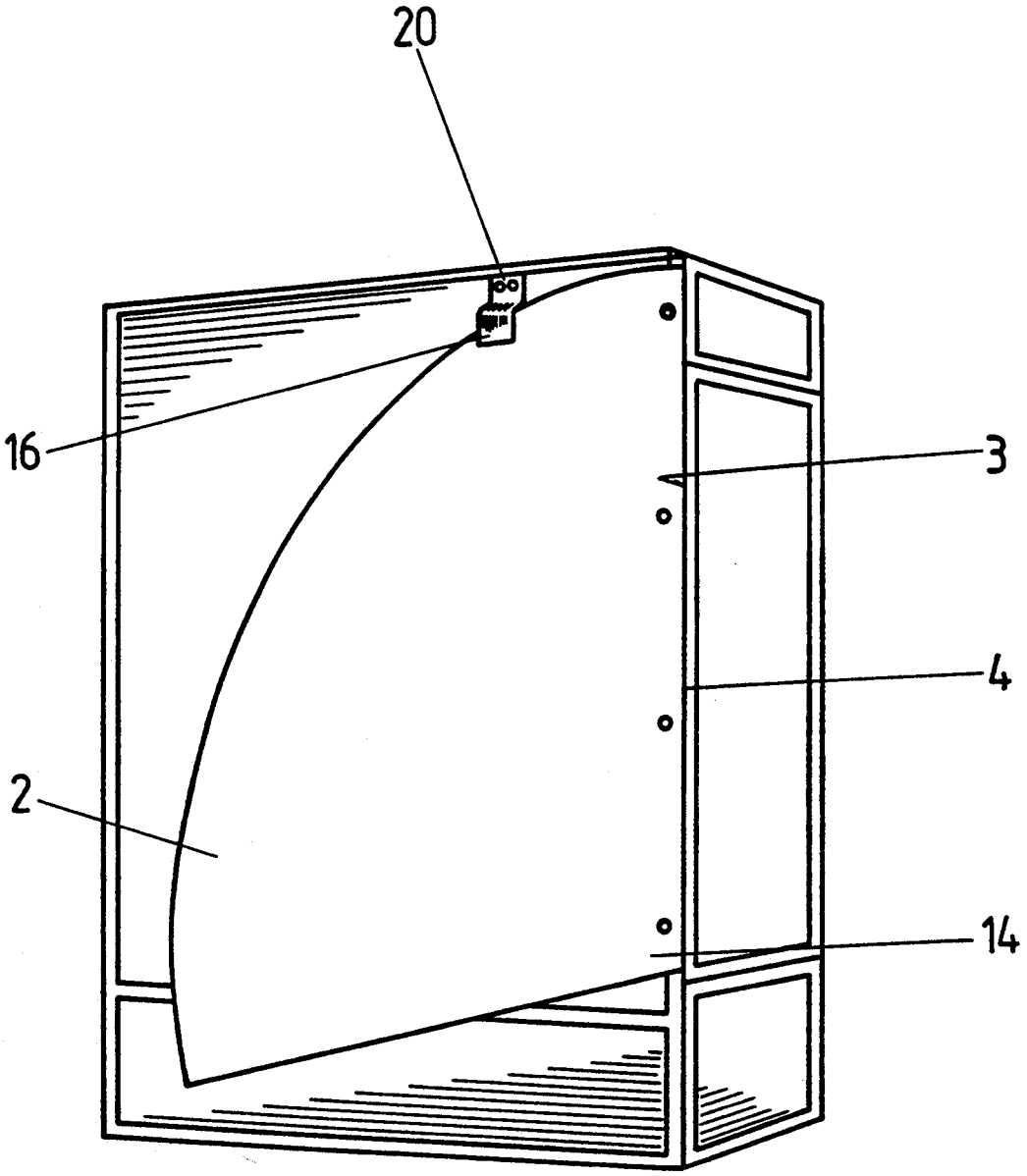
FIG. 2 is a lateral view of a splashguard in a closed position of a dishwasher.
Figure 3:
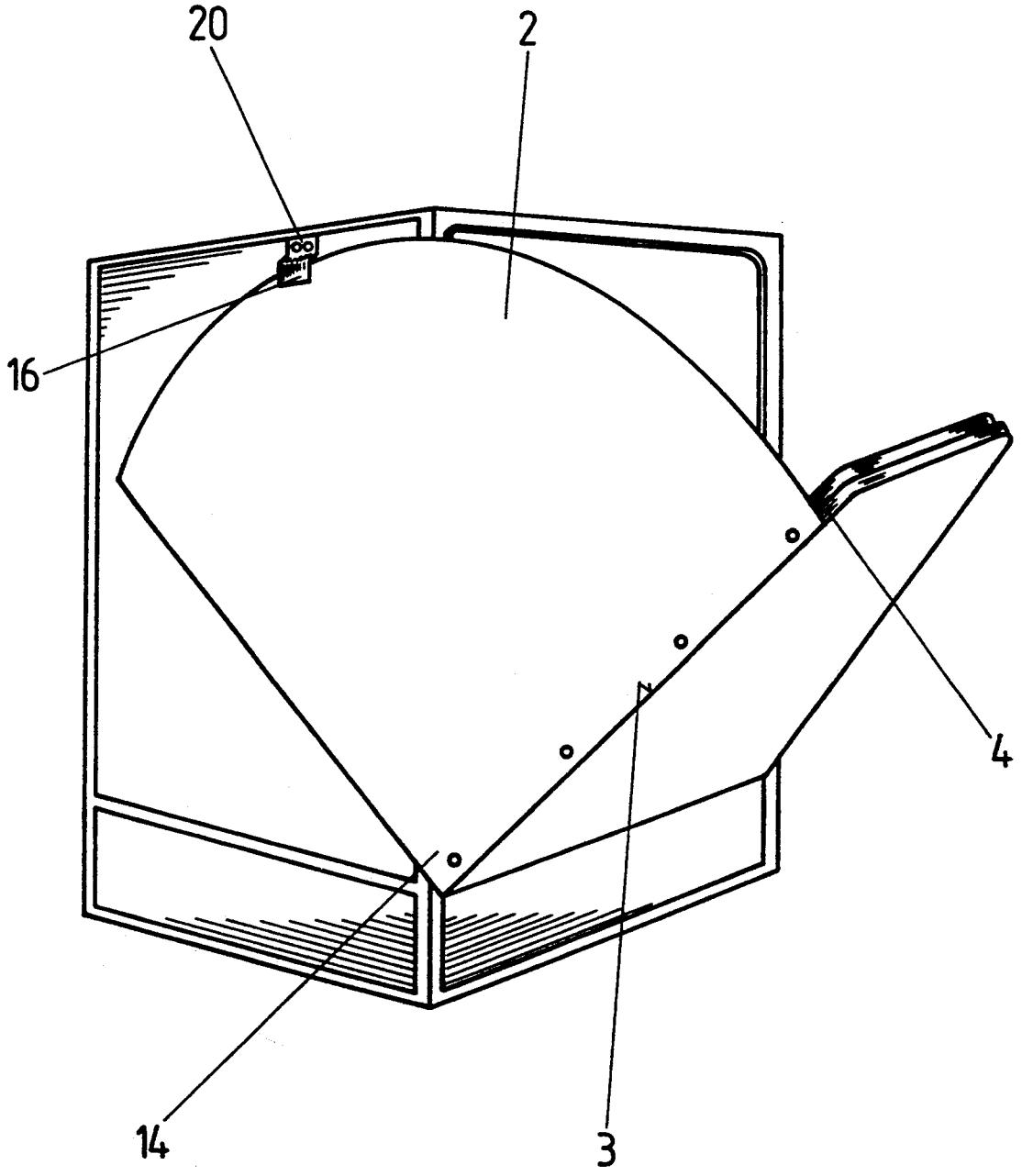
FIG. 3 is a lateral view of a splashguard of a dishwasher in a partially open position.
Figure 4:
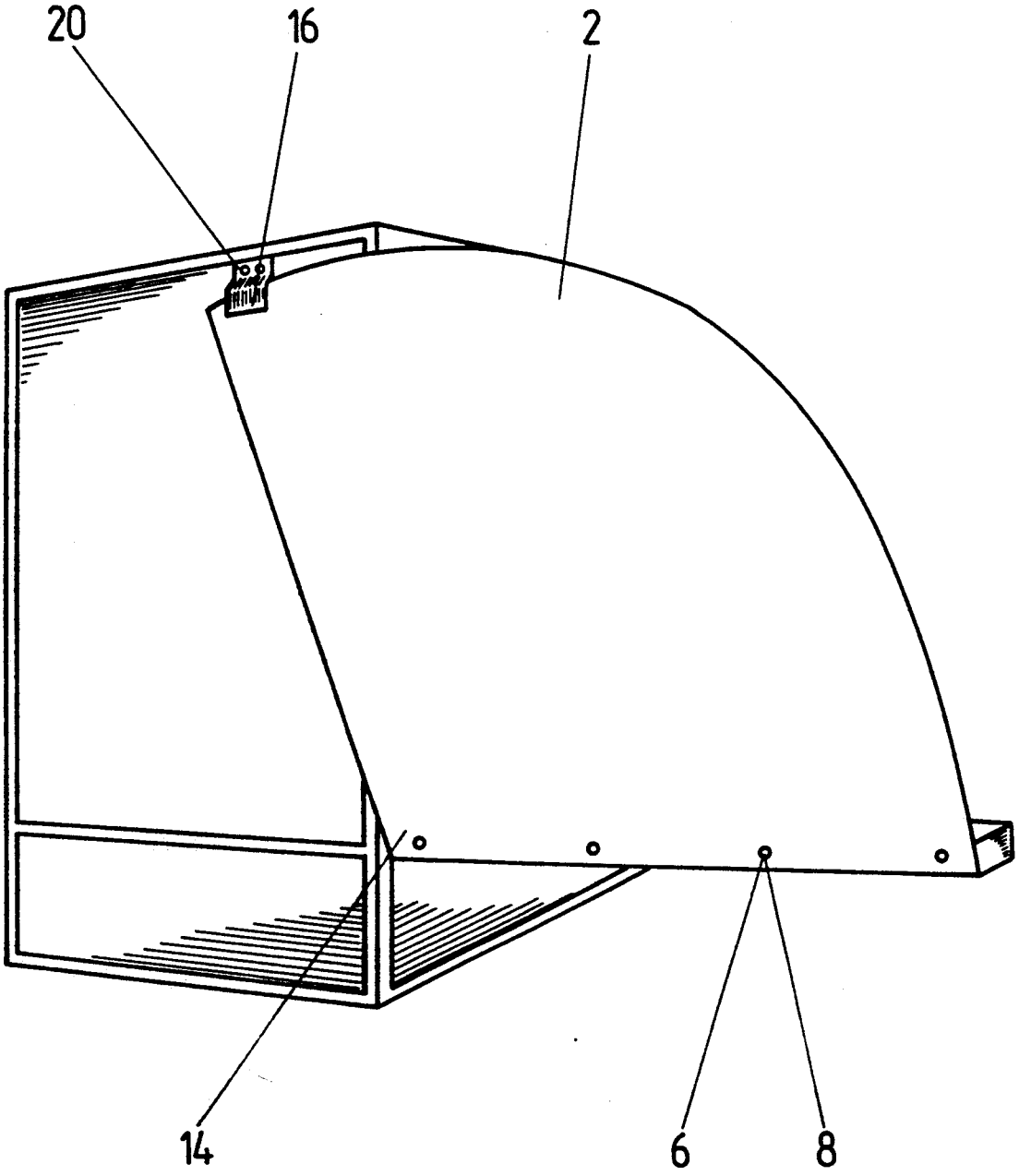
FIG. 4 is a lateral view of a splashguard in a fully open position of a dishwasher.

The splashguard 2 is formed as a section of a circular plate, where the size of the radius corresponds substantially to the length of the side of the door opening of the dishwasher, as illustrated in FIGS. 2, 3, and 4. The splashguard 2 is generally made of a sturdy material which exhibits two smooth surfaces and is resistant to the corrosive conditions which occur during the operation of a dishwasher. The smooth surfaces of the material of the splashguard 2 promote a fast run-off of liquids and are easy to clean. The material utilized is preferably a plastic material, in particular an acrylic material, and can have a thickness of approximately 0.5 centimeter to 1.0 centimeter or approximately ⅛ inch to ⅜ inch. Alternatively, the splashguard 2 can be made of a metal such as, for example, stainless steel or enamelled steel, or corrosion-resistant aluminum or copper. The splashguard 2 is preferably coated with a metal enamel or enamel paint or sprayed with a plastic coating which is resistant to heat, scratching, water, and corrosion. The splashguard 2 can also be coated with a ceramic enamel. The ceramic enamel is an enamel comprising a substantial amount of ceramic materials. The splashguard material preferably is of a color matching the interior of the dishwasher.

Figure 5:
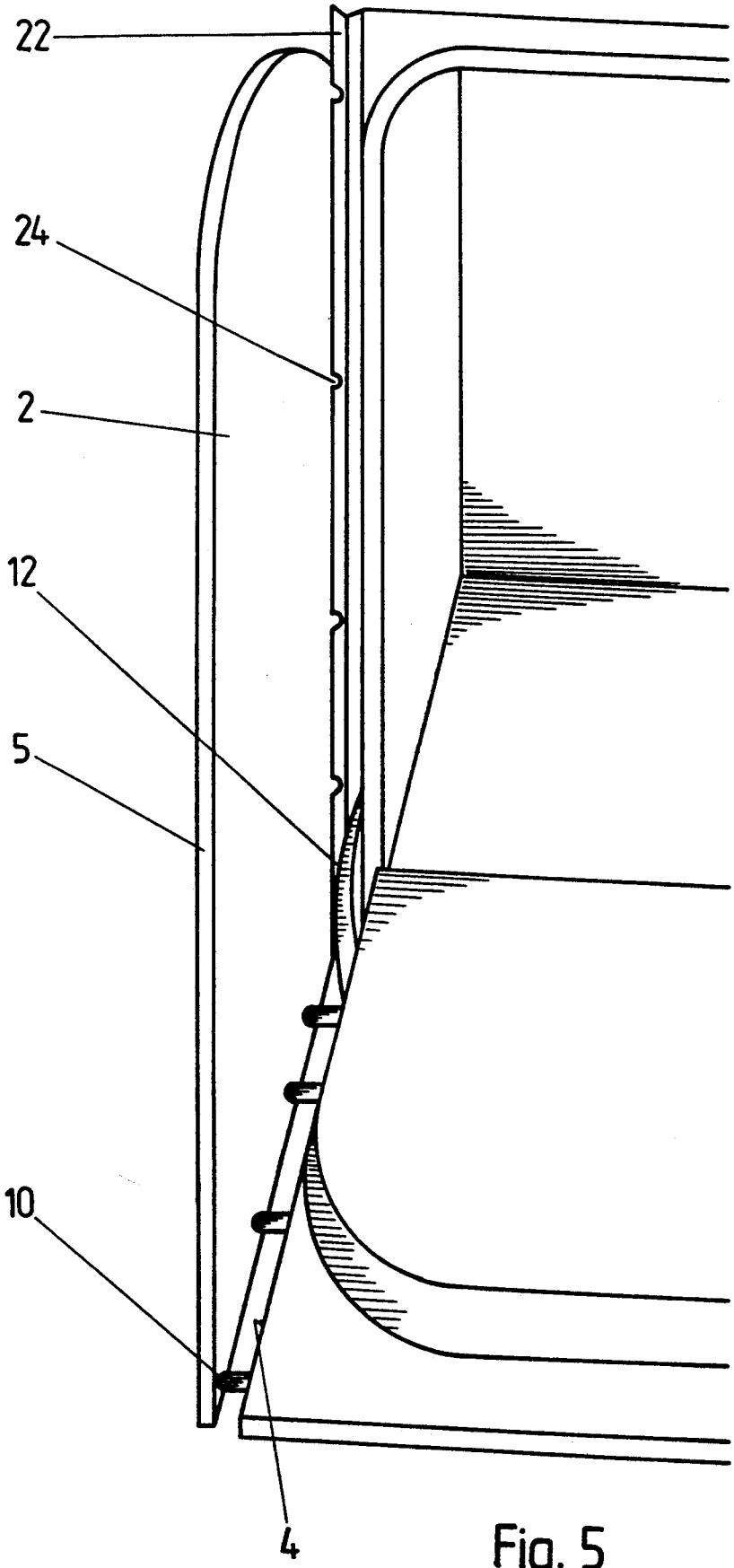
FIG. 5 is a front elevational view of a dishwasher showing the position of a splashguard in a fully opened position.

The attachment edge 3 of the splashguard 2 is attached to the side face edge 4 of the dishwasher door on the side which is to be protected against splashing from the dishwasher. The splashguard 2 is positioned approximately ½ inch away from the side face edge 4 of the door (see FIGS. 5 and 6), and fastened with the aid of screws 6, washers 8, and bushings 10 (see FIGS. 4, 5, 6). The splashguard 2 and the dishwasher door will pivot together at the door hinge 12 when opening or closing (see FIGS. 5, 7).

The angle of the splashguard 2 can be from 100 to 130 degrees and is preferably from 105 to 120 degrees as measured from the side face edge 4 of the door of the dishwasher.

The obtuse angle of the splashguard 2 has its center position 14 aligned with the hinge axis of the dishwasher door, and one edge 3 of the splashguard is permanently secured along the entire height of a side face edge 4 or length of the dishwasher door (see FIGS. 2, 3, 4, 5).

The splashguard 2 is attached on its attachment edge 3 with screws 6 to the side face edge 4 of the dishwasher door.

Liquids and food particles which have splashed or spilled onto the splashguard 2 are preferably deflected onto an area of the opened door of the dishwasher and run off into the dishwasher when closing the dishwasher door.

A guide 16 has to be positioned and attached to the outside wall of the dishwasher for guiding the splashguard 2, allowing the free movement of the splashguard 2 when opening or closing the dishwasher door (see FIGS. 2, 3, 4, 9). The guide 16 is preferably made of a flat piece of metal together with a bracket 20, which straddles both sides of the splashguard 2. The inside of the guide 16 facing the splashguard 2 is preferably provided with rubber bumpers 18 on each side so that the surface of the splashguard 2 is not damaged when sliding through the guide 16.

Figure 9:
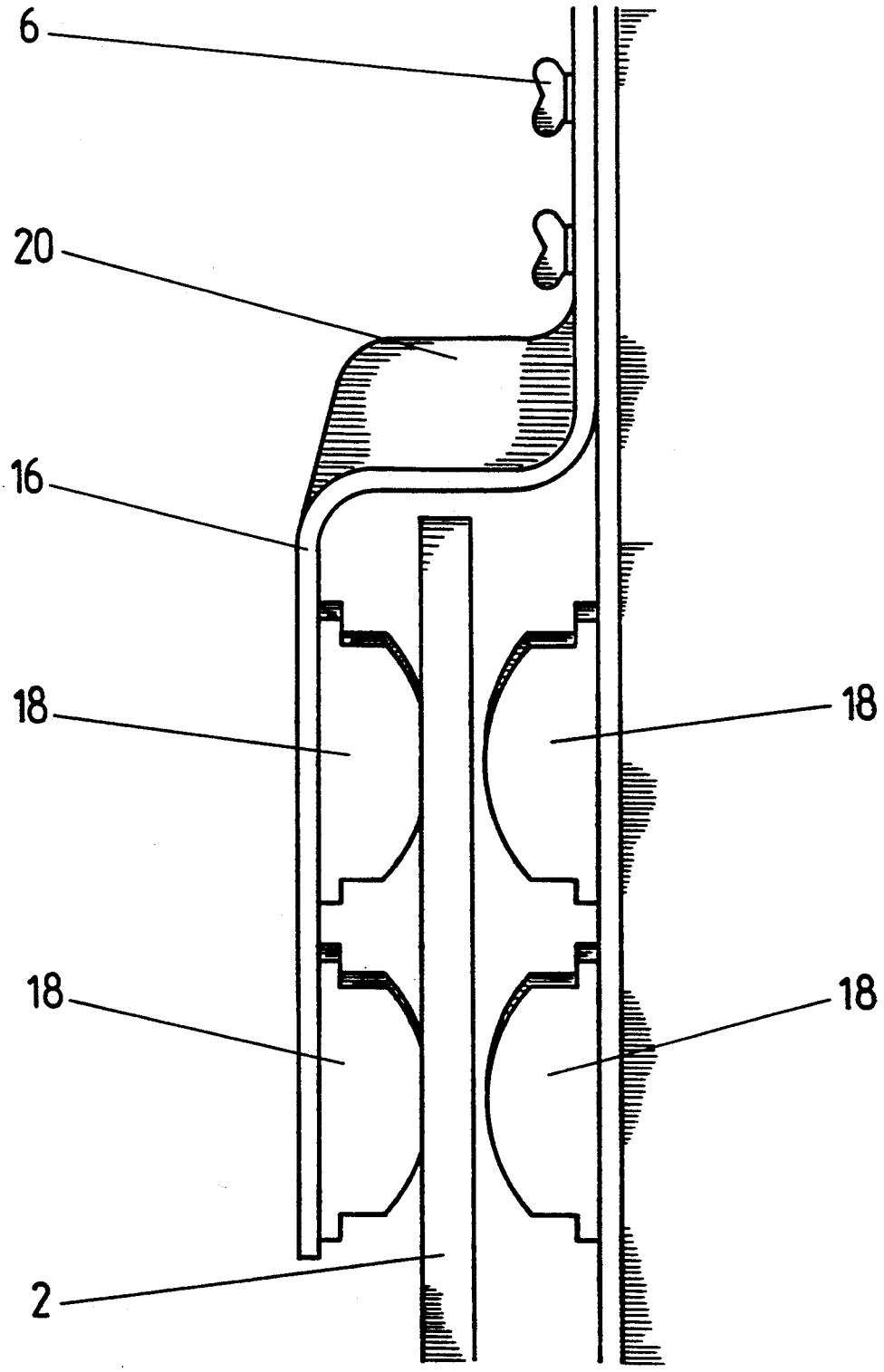
FIG. 9 is a detailed view of the guide for the splashguard.
Figure 10:
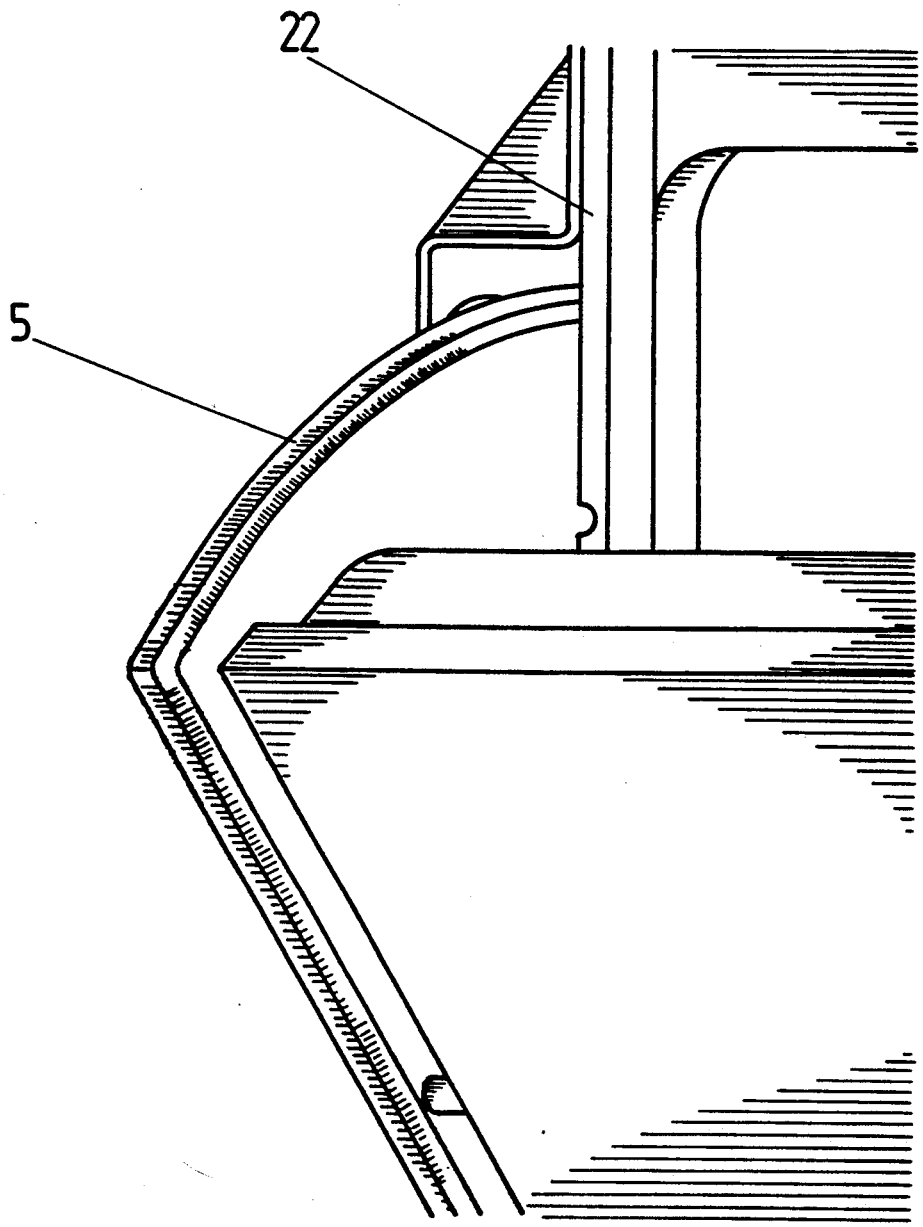
FIG. 10 is a view similar to that of FIG. 8, however with a channel piece furnishing a trim.

FIG. 9 illustrates the position of the bumpers 18 within the guide 16 for the dishwasher splashguard 2.

Figure 6:
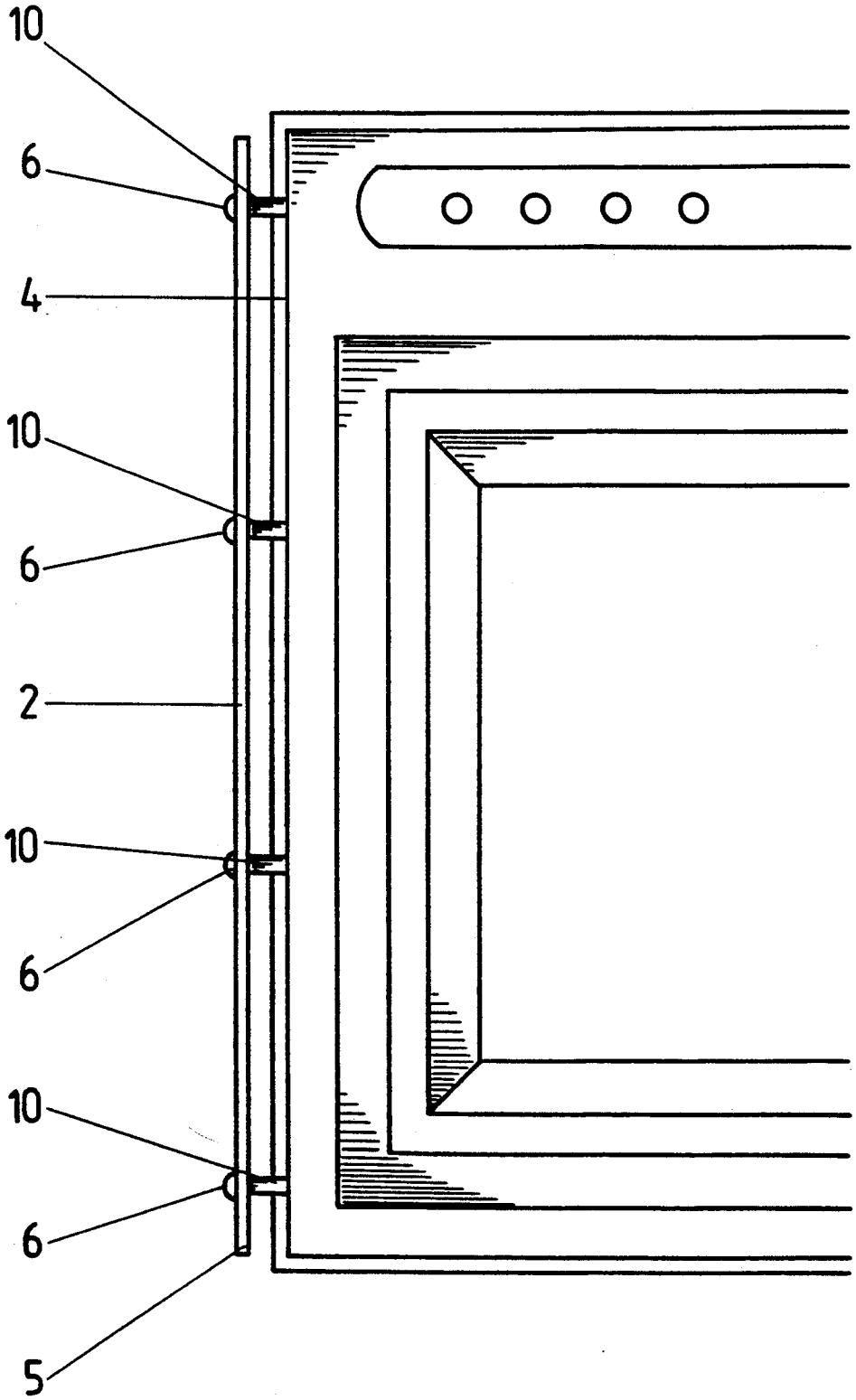
FIG. 6 is a front view of a closed dishwasher with the position of a splashguard.
Figure 8:
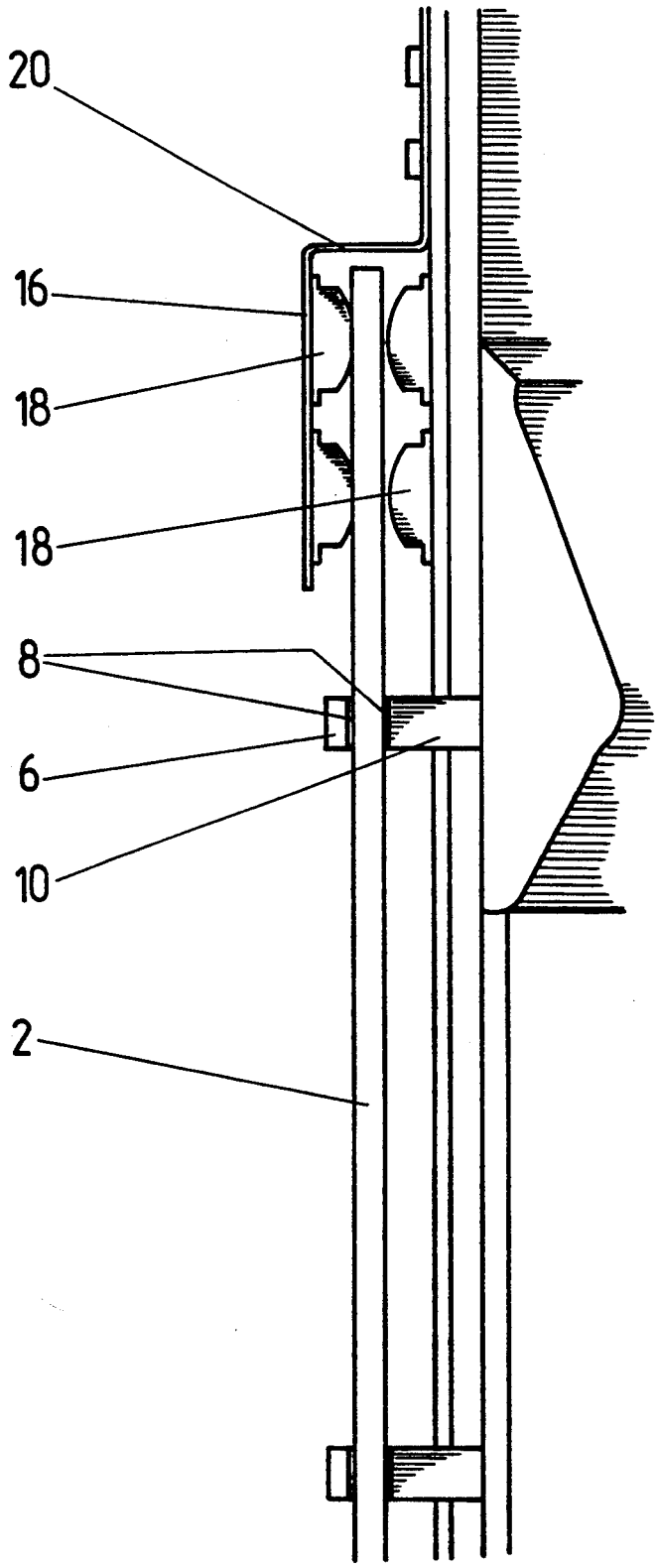
FIG. 8 is a detailed view of the screws, washers, and bushings attaching the splashguard, and the guide straddling the angular sector.

FIG. 6 illustrates how the splashguard 2 is spaced away from the side of the door of the dishwasher. The splashguard 2 is fastened to the side face edge 4 of the dishwasher door with screws 6, washers 8, and bushings 10 (see FIGS. 4, 5, 6). The bushings 10 are used to space the splashguard 2 at a distance of approximately ½ inch away from the edge of the dishwasher door and also away from the outside dishwasher wall (see FIGS. 5, 6, 8). This spacing will allow the splashguard 2 to slide vertically along the outside of the dishwasher unit and to move freely when opening and closing the dishwasher door. The size of the bushings 10 will depend on the construction of the dishwasher and, in particular, on any difference between the splashguard 2 and the position of the outside wall of the dishwasher versus the splashguard 2 and the position of the door of the dishwasher. The bushings 10 can be made of ⅜ inch chrome-plated copper tubing.

Figure 7:
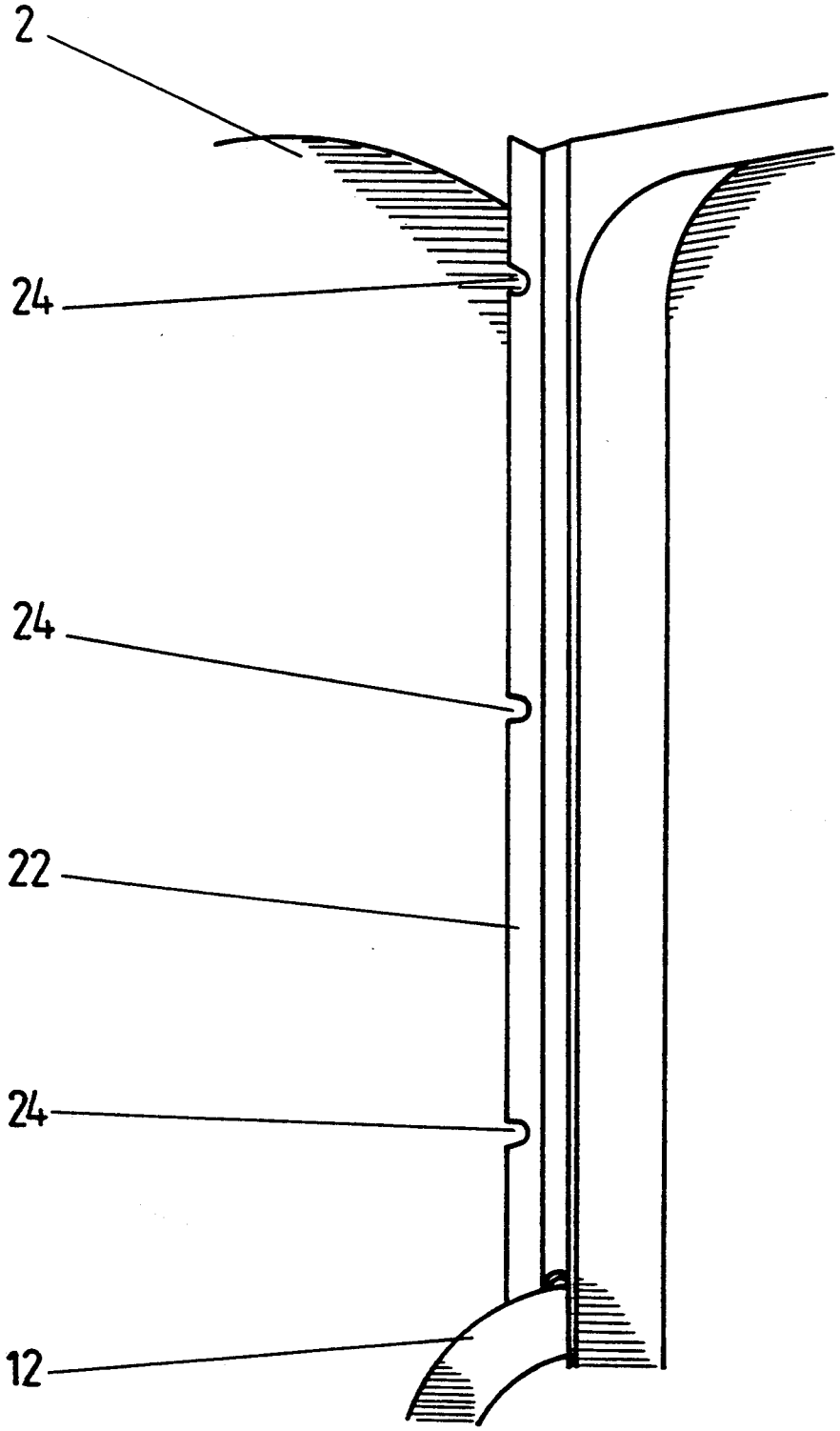
FIG. 7 is a detailed view of the hinged area of a dishwasher with the position of a splashguard, and the notches in the side trim to receive the bushings.

Dishwashers with side trim 22 must include notches (24) to receive the bushings 10, so the door can be fully closed and locked (see FIG. 7).

For a finished look, and also for additional support, a channel piece of chrome trim 5 could be mounted to the entire edge of the splashguard.

It will be understood that each of the elements described above, or two or more together, may also find a useful application in other types of splashguards differing from the types described above.

While the invention has been illustrated and described as embodied in the context of a splashguard device for a dishwasher, it is not intended to be limited to the details shown, since various modifications and structural changes may be made without departing in any way from the spirit of the present invention.

Without further analysis, the foregoing will so fully reveal the gist of the present invention that others can, by applying the current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A splashguard device for a dishwasher comprising
an angular sector of a circular plate, wherein the angular sector has a sector angle of from about 100 to 130 degrees, wherein a radius of the circular plate substantially equals a radial length of a dishwasher door determined from a hinge axis of the dishwasher door;
a plurality of fastening devices to permanently secure the angular sector at a radially extending edge of the angular sector to a radially extending side face of the dishwasher door;
spacer devices for spacing the angular sector at a distance of approximately ½ from the radially extending side face of the dishwasher door in a vertical plane parallel to an outer face of a dishwasher outside wall; and
a guide attached to the dishwasher outside wall to ensure a free movement of the angular sector.

2. The splashguard device according to claim 1, wherein the sector angle is from about 105 to 120 degrees and wherein the angular sector has a thickness of from between about 0.5 centimeter and 1 centimeter.

3. The splashguard device according to claim 1, wherein the sector angle exhibits a smooth surface on the radially extending edge of the angular sector.

4. The splashguard device according to claim 1, wherein the angular sector of the circular plate is made of plastic.

5. The splashguard device according to claim 1, wherein the angular sector of the circular plate is made of stainless steel.

6. The splashguard device according to claim 1, wherein the angular sector of the circular plate is made of steel.

7. The splashguard device according to claim 1, wherein the angular sector of the circular plate is made of aluminum.

8. The splashguard device according to claim 1, wherein the angular sector of the circular plate comprises a copper alloy.

9. The splashguard device according to claim 1, wherein the angular sector of the circular plate is coated with a metal enamel.

10. The splashguard device according to claim 1, wherein the angular sector of the circular plate is coated with a ceramic enamel.

11. The splashguard device according to claim 1, wherein the angular sector of the circular plate is coated with a plastic coating resistant to heat, scratching, water and corrosion.

12. The splashguard device according to claim 1, wherein the fastening devices include screws permanently secured to the extending directed side face of the door.

13. The splashguard device according to claim 1, wherein the spacer devices are provided by bushings.

14. The splashguard device according to claim 13, wherein the bushings are made of ⅜ inch chrome-plated copper tubing.

15. The splashguard device according to claim 13, wherein the
bushings are used to space the angular sector at approximately 0.5 inch away from the dishwasher door and away from the dishwasher outside side wall.

16. The splashguard device according to claim 15, further comprising
a side trim attached to an outside front sidewall frame of the dishwasher, wherein the side trim is notched to receive the bushings to provide a closing and locking of the dishwasher door.

17. The splashguard device according to claim 1, wherein the guide for the angular sector is secured on the outside sidewall of the dishwasher and guides the angular sector substantially within a vertical plane during opening and closing of the dishwasher door.

18. The splashguard device according to claim 17, wherein the guide is provided by a flat piece of metal together with a bracket so that the bracket straddles a part of the periphery of the angular sector.

19. The splashguard device according to claim 18, wherein the guide includes rubber bumpers mounted on the bracket and facing the angular sector for avoiding wear and scratching of the angular sector sliding through the bracket.

20. The splashguard device according to claim 1, further comprising
a channel piece of chrome trim mounted to the entire edge of the splashguard for additional support and a finished look.

* * * * *